US009096246B2

(12) United States Patent
Fanara et al.

(10) Patent No.: US 9,096,246 B2
(45) Date of Patent: Aug. 4, 2015

(54) DETERMINING POSITIONAL RELATIONSHIPS BETWEEN CARS IN A CONSIST

(71) Applicant: Electro-Motive Diesel, Inc., Lagrange, IL (US)

(72) Inventors: Mark Alan Fanara, Blue Springs, MO (US); Gregory Raymond Kupiec, Lemont, IL (US); Warren Douglas Burnett, Lee's Summit, MO (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 169 days.

(21) Appl. No.: 13/974,299

(22) Filed: Aug. 23, 2013

(65) Prior Publication Data

US 2015/0053828 A1 Feb. 26, 2015

(51) Int. Cl.
*B61L 25/02* (2006.01)
*B61L 15/00* (2006.01)

(52) U.S. Cl.
CPC ..... *B61L 25/028* (2013.01); *B61L 15/0036* (2013.01)

(58) Field of Classification Search
CPC ..... B61L 25/028; B61L 15/036; B61C 17/02
USPC ..... 701/19
See application file for complete search history.

(56) References Cited

U.S. PATENT DOCUMENTS

| | | | | |
|---|---|---|---|---|
| 4,689,602 | A | 8/1987 | Morihara et al. | |
| 5,986,579 | A | 11/1999 | Halvorson | |
| 6,172,619 | B1 | 1/2001 | Lumbis et al. | |
| 6,408,766 | B1 * | 6/2002 | McLaughlin et al. | 105/231 |
| 6,456,937 | B1 | 9/2002 | Doner et al. | |
| 2007/0239327 | A1 | 10/2007 | Smith et al. | |
| 2010/0020723 | A1 * | 1/2010 | Tatsumi et al. | 370/254 |
| 2014/0033943 | A1 * | 2/2014 | Foege et al. | 105/1.4 |
| 2014/0033946 | A1 * | 2/2014 | Billig et al. | 105/35 |
| 2014/0034151 | A1 * | 2/2014 | Foege | 137/345 |
| 2014/0358336 | A1 * | 12/2014 | Otsubo et al. | 701/19 |

FOREIGN PATENT DOCUMENTS

AU 2002 301910 3/2002

OTHER PUBLICATIONS

EIC 3600 Search Report dated Mar. 18, 2015.*

* cited by examiner

*Primary Examiner* — John Q Nguyen
*Assistant Examiner* — Michael Whalen
(74) *Attorney, Agent, or Firm* — Finnegan, Henderson, Farabow, Garrett & Dunner, LLP

(57) ABSTRACT

A method is disclosed for determining the positional relationship between a locomotive in a consist and a tender car in the consist. The method may include transmitting a signal from a locomotive controller to the tender car. The signal may be processed at the tender car in a manner uniquely indicative of one end of the tender car. A locomotive controller associated with the locomotive may receive an indication of an effect of the signal processing, and use the indication to establish the positional relationship between the locomotive and the one end of the tender car. The locomotive controller associated with the locomotive may transmit a signal indicative of fuel requirements and including the positional information to a controller associated with the tender car. The tender car controller may transfer fuel from the one end of the tender car to the locomotive.

19 Claims, 2 Drawing Sheets

DETERMINING POSITIONAL RELATIONSHIPS BETWEEN CARS IN A CONSIST

TECHNICAL FIELD

The present disclosure is directed to determining positional relationships and, more particularly, to determining positional relationships between cars in a consist.

BACKGROUND

In locomotive consists where the locomotives are powered by natural gas, there is a need to determine the positional relationships between the locomotives and a tender car carrying the natural gas. When transporting natural gas, the most efficient means is to transport it in a liquid state. Liquefied natural gas ("LNG") takes up only a fraction (about 1/600) of the volume of natural gas in its gaseous state, and may be maintained in its liquid state in cryogenic compartments. LNG is stored in cryogenic compartments either at or slightly above atmospheric pressure. To produce LNG, natural gas is cooled below its boiling point (about −161° C. at ambient pressure). While it is practical to transport LNG because it takes up a fraction of the volume of natural gas in its gaseous state, natural gas is usually required in its gaseous state for combustion. LNG may be converted into its gaseous form by raising the temperature of the LNG. There are advantages to transporting the natural gas in liquid form, and a desire to reduce the distance over which the natural gas must be piped in its gaseous state to reach the engines on the locomotives. As a result, there is a desire to provide a tender car as part of the locomotive consist.

A tender car provided as part of a locomotive consist will need to receive communications from the locomotives in the consist related to the individual fuel requirements of each locomotive. The positional relationships between the locomotives and the tender car may need to be determined. Information on the positional relationships between cars in a consist may be used to identify which locomotive a particular fuel requirement is coming from, and which end of the tender car the fuel should be supplied from.

One attempt at determining the positional order of the various cars in a train is described in U.S. Pat. No. 4,689,602 (Morihara et al.), which describes a system including a selecting relay that applies an input signal to one of plural data transmitting devices, one being located on each car of the train. Each of the data transmitting devices are connected through extension lines to a single, common line. Logic circuits are provided for the extension lines to supply, in response to an output signal from the respective data transmitting devices, a supply voltage to the following data transmitting device. In the case of a train with more than two cars, the front car must be selected first, and then the data transmitting devices on each of the remaining cars are started in succession, with the position of each car being registered at the data transmitting device on the front car.

Although the system disclosed by Morihara et al. may improve the ability to detect the various positions of cars in a train, the system requires the initial selection of a front car. Data must then be transmitted from successive data transmission devices along the train back to the front car in order to register the proper positional relationships between the cars. The system disclosed by Morihara et al. does not provide a way for a tender car controller connected by a common communication link with plural locomotives to distinguish between the locomotives. The system disclosed by Morihara et al. also does not provide a way for each of the locomotives connected to a tender car to identify which end of the tender car the locomotive is connected to.

The disclosed system and method is directed to overcoming one or more of the problems set forth above and/or elsewhere in the prior art.

SUMMARY

In one aspect, the disclosure is directed to a method of determining the positional relationship between a locomotive in a consist and a tender car in the consist. The method may include transmitting a signal from a locomotive controller to the tender car and processing the signal at the tender car in a manner uniquely indicative of one end of the tender car. The method may further include receiving an indication of an effect of the signal processing at a locomotive controller associated with the locomotive. The locomotive controller associated with the locomotive may use the indication of an effect of the signal processing to establish the positional relationship between the locomotive and the one end of the tender car. The locomotive controller associated with the locomotive may transmit a signal indicative of a fuel requirement and including the positional relationship to a controller associated with the tender car. Fuel may then be transferred from the one end of the tender car to the locomotive.

In another aspect, the disclosure is directed to a system for determining the positional relationship between vehicles in a consist. The system may include a locomotive, and a tender car. The tender car may include operational characteristics that identify and distinguish between respective ends of the tender car. A tender car controller may be associated with the tender car, and a locomotive controller may be associated with the locomotive. The locomotive controller may be configured to transmit a signal to the tender car that will activate at least one of the operational characteristics, and identify results of activating a unique operational characteristic associated with an end of the tender car connected to the locomotive.

In still another aspect, the disclosure is directed to a system for determining the positional relationship between vehicles in a consist. The system may include a locomotive, and a tender car. A natural gas conduit may connect the locomotive and the tender car. A tender car controller may be associated with the tender car, and a locomotive controller may be associated with the locomotive. The locomotive controller may be configured to transmit a signal to the tender car controller that will enable the tender car controller to identify which end of the tender car is connected to the locomotive by the natural gas conduit.

DETAILED DESCRIPTION

Figure 1:
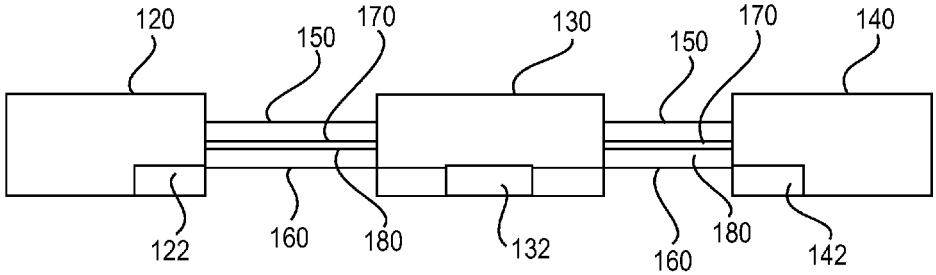
FIG. 1 is a block diagram of an exemplary system for determining the positional relationship between a locomotive and a tender car in a consist.
Figure 2:
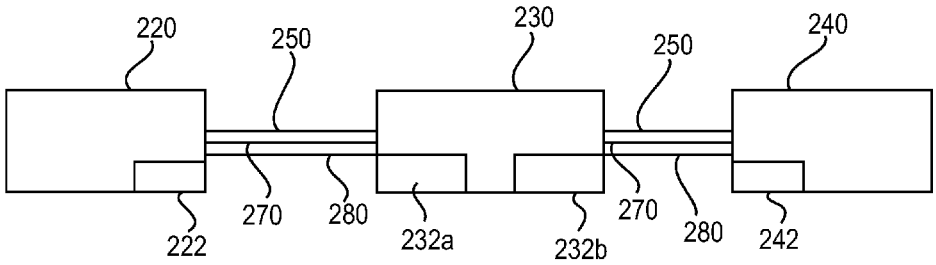
FIG. 2 is a block diagram of another exemplary system for determining the positional relationship between a locomotive and a tender car in a consist.
Figure 3:
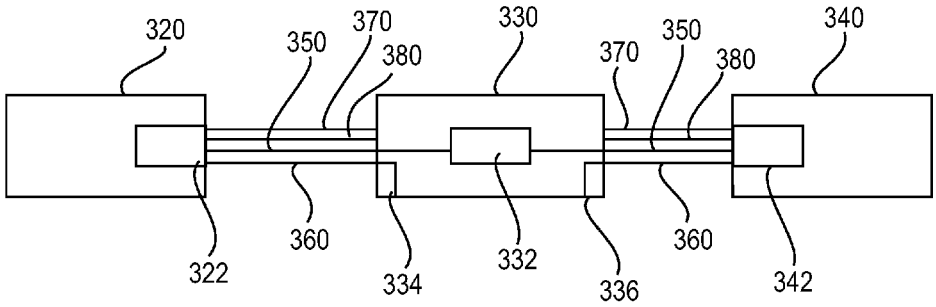
FIG. 3 is a block diagram of still another exemplary system for determining the positional relationship between a locomotive and a tender car in a consist.

FIGS. 1-3 illustrate schematic diagrams of a locomotive consist with plural locomotives that utilize natural gas for fuel, and a tender car that supplies the natural gas to the locomotives. The exemplary systems of FIGS. 1-3 provide various ways to determine which end of the LNG tender car each locomotive is connected to, and which locomotive is attempting to communicate with the tender car. In all of the illustrated exemplary implementations, a first locomotive is connected to a first end of a tender car, and a second locomotive is connected to a second end of the tender car. A fuel tender car may be provided in a locomotive consist in order to increase the range over which a train may travel without refueling stops. The tender car may deliver fuel to each of the locomotives in the consist independently. The tender car has a first end and a second end, either of which may be oriented closer to the front of the train. One or more locomotives of the consist may be connected to the tender car at the first end of the tender car, and one or more locomotives of the consist may be connected to the tender car at the second end of the tender car. One of ordinary skill in the art will recognize that other configurations are possible. For example, additional locomotives may be connected downstream or upstream from either end of the tender car. Natural gas conduits may be provided to supply natural gas from either end of the tender car to the locomotives immediately adjacent to each end of the tender car and/or additional locomotives connected at other positions in the consist. Although not illustrated, the connections on each locomotive may be located only at the long hood end of each locomotive. In such an exemplary implementation, one locomotive on one end of the tender car may be facing long hood rearward, and the locomotive on the opposite end of the tender car may be facing long hood forward. The "long hood" of a locomotive normally contains the engine (prime mover), main generator or alternator, the locomotive's cooling radiators, and most of the locomotive's auxiliary equipment.

In each of the exemplary implementations illustrated in FIGS. 1-3, a number of connections are illustrated between each locomotive and the tender car. These connections may include natural gas conduits for transferring natural gas in a gaseous state from the tender car to each of the locomotives. Conduits may also be provided for transferring vaporizer heating fluid, such as glycol, from the locomotives to the tender car. The vaporizer heating fluid may be heated by heat exchangers on the locomotives and used at the tender car to heat up the LNG in the process of converting the natural gas into a gaseous state. Heat produced by one or more engines on each locomotive may be used in the process of heating the vaporizer heating fluid. Compressed air pipes may also run between the locomotives and the tender car as part of a pneumatic braking system. Additional connections between the tender car and the locomotives may include one or more multi-unit (MU) cables. These MU cables may include a standard 27 pin MU cable used to transfer throttle commands and other data communications between the locomotives in the consist. If desired, a secondary MU cable may be provided for the transfer of signals related to the delivery of gaseous natural gas to each locomotive. One or more power cables may also run between the locomotives and the tender car to provide power used by various devices on the tender car.

Various alternative implementations of the disclosed system facilitate the automatic determination of the positional relationships between locomotives in the consist and the tender car configured to supply each of the locomotives with natural gas. One or more controllers associated with each locomotive and with the tender car may be implemented in digital electronic circuitry, integrated circuitry, specially designed ASICs (application specific integrated circuits), computer hardware, firmware, software, and/or combinations thereof. These various implementations may include implementation in one or more computer programs that are executable and/or interpretable on a programmable system including at least one programmable processor and/or programmable logic controller (PLC). The associated programmable processors may be special or general purpose, coupled to receive data and instructions from, and to transmit data and instructions to, a storage system, at least one input device, and at least one output device. A controller associated with a locomotive may be located on board the locomotive, or may be located remotely at a central control station or a wayside station. Similarly, a controller associated with the tender car may be located on board the tender car, or may be located remotely at a central control station or a wayside station.

Controllers associated with the attached locomotives may communicate with each other and with a controller associated with the tender car via independent or common communication paths. When the locomotive controllers associated with each locomotive use independent communication paths to communicate with the tender car controller, the physical connections of each of the independent communication paths may be sufficient for the tender car controller to identify which locomotive is attempting to communicate. When the locomotive controllers use a common communication path to communicate with the tender car controller, the locomotive controllers may need to provide additional identification information. High speed communication networks may be employed in a locomotive consist using a common ethernet communication bus. The ethernet communication signals may be superimposed over other digital communication signals carried by some of the wires in existing multi-unit (MU) cables. MU cables provide trainline communications between the locomotives in a consist, including operational commands such as throttle control settings. The networking standard employed in the consist may include an inter-consist communication (ICC) router and an ethernet bridge device on each locomotive and tender car. When using a common communication link over ethernet between all of the locomotives and the tender car it may be necessary to provide positional information with signals sent from each locomotive to the tender car. This positional information allows the tender car controller to identify the origin of signals transmitted over the common communication link and received at a single ethernet port on the tender car controller. The tender car may use the positional information to associate each signal with a particular locomotive connected to the tender car, and distinguish fuel requirements or other communications received from each locomotive.

The tender car may include any number of characteristics uniquely indicative of each end of the tender car. In various implementations, a tender car may have a separate glycol pump at each end of the tender car. Alternatively, a heat exchanger and pump may be provided on each associated locomotive, and a conduit for transferring a vaporizer heating fluid such as glycol may be connected between an associated locomotive and an adjacent end of the tender car. Heated vaporizer fluid such as glycol may be provided through a conduit to another heat exchanger located at one or both ends of the tender car. The heat exchangers may be used for heating up the LNG and converting it into gaseous form suitable for combustion by natural gas-powered engines on each locomotive. An example of a unique operational characteristic associated with one end of the tender car may include the receipt of vaporizer heating fluid through the conduit connected to that one end of the tender car. The operational characteristic may include activation of one or more valves that control the flow of the vaporizer heating fluid. Another example may include the operation of a pump used to transfer gaseous natural gas from that end of the tender car. Additional characteristics uniquely indicative of each end of the tender car may include optical tags configured to be read by optical readers on an adjacent locomotive, proximity sensors, magnetic hall effect sensors, radio-frequency identification (RFID) sensors, short range wireless and directional antennas, and other devices configured to provide positive identification of an adjacent locomotive. All of the above-discussed characteristics associated with a particular end of the tender car may provide positional information to a locomotive connected at that end of tender car. The positional information provided to the locomotive may be included in communications between the locomotive and the tender car. This positional information may be included, for example, as metadata attached to other digital signals sent from the locomotive controller over a common ethernet bus. In an exemplary implementation, the tender car controller receives a fuel request signal from a locomotive controller over the common ethernet bus. The fuel request signal may include the positional relationship between the locomotive sending the signal and the end of the tender car that locomotive is connected to.

As shown in the exemplary implementation of FIG. 1, a first locomotive 120 may be connected to a first end of a tender car 130, and a second locomotive 140 may be connected to a second end of tender car 130. A locomotive controller 122 may be associated with first locomotive 120, and a locomotive controller 142 may be associated with second locomotive 140. A tender car controller 132 may be associated with tender car 130. Although the locomotive controllers and tender car controller are illustrated as being located physically on each of the associated locomotives and tender car, alternative implementations may provide the controllers on a different locomotive, off-board at a central control station, or at a wayside station. A natural gas conduit 170 may be connected between each end of tender car 130 and an adjacent locomotive. Similarly, a vaporizer heating fluid conduit 180 may be connected between each end of tender car 130 and an adjacent locomotive.

Additional features and operational characteristics at each end of the tender car may include cryogenic pumps, gas pumps, compressors, valves, and sensors used in the handling, safety monitoring, and distribution of the natural gas in its liquefied and gaseous states. These features and operational characteristics of the tender car may be uniquely indicative of each end of the tender car, and may therefore be utilized to facilitate identification of each end of the tender car. Characteristics associated with fuel flow and distribution on board the tender car may contribute to a desire to identify which end of the tender car a locomotive is connected to. Gradient effects on fuel flow, and the effects of fuel slosh within the cryogenic tank on the tender car may result in the desirability of drawing fuel from the end of the tender car closest to the locomotive. Fuel slosh can be exemplified by motion of the cryogenic fluid in the tank of the tender car, and characterized by inertial waves that may affect the operation of pumps, compressors, heat exchangers, and other operational characteristics of the tender car.

Communication between the locomotives and tender car in a consist may be facilitated by an inter-consist communication (ICC) network implemented over an existing standard 27 pin multi-unit (MU) cable. High speed communication may occur over a common ethernet communication link incorporated into the MU cable. The MU cable may be the standard 27 pin MU cable already provided for communicating locomotive operational parameters, such as throttle command settings between the locomotives in the consist. In alternative implementations, a secondary MU cable may also be provided for communicating natural gas processing instructions. Ethernet communications may be superimposed on other digital signals being transferred over one or more of the lines in the primary and/or secondary MU cables.

In the exemplary implementation of FIG. 1, a primary MU cable 150 may connect between locomotive 120 and locomotive 140 without providing any communication signals to tender car 130. A secondary MU cable 160 may be provided to connect between locomotive controller 122 on locomotive 120, tender car controller 132 on tender car 130, and locomotive controller 142 on locomotive 140. The controllers associated with each locomotive and tender car in the consist may exchange various control signals. These signals may include simple logic signals that perform functions such as initiating handshake protocols to coordinate data transfer between a locomotive controller and the tender car controller. The handshake protocols may ensure that data is not transmitted until a receiving controller is ready for the data. Additional signals may be indicative of a gas request sent by a particular locomotive connected to the tender car, acknowledgement of gas delivery, and steady state or transitory parameters such as health status, or gas levels remaining in the tank. An ethernet bridge device may be located on each locomotive and on the tender car as part of a common communication link between all of the locomotives and the tender car. This simplified "party line" type of communication bus architecture may provide for only one connection at the tender car controller. As a result, tender car controller 132 may need additional information in order to identify which locomotive is attempting to communicate, and which end of the tender car the locomotive is connected to.

In the exemplary implementation illustrated in FIG. 2, point-to-point ethernet communication may be established between locomotive 220 and tender car 230, and between tender car 230 and locomotive 240. MU cable 250 may be configured to carry all ethernet communication signals between a locomotive controller 222 on locomotive 220 and a first distinct tender car controller port 232*a*. MU cable 250 may also be configured to carry all ethernet communication signals between a locomotive controller 242 on locomotive 240 and a second distinct tender car controller port 232*b*. MU cable 250 may be an existing MU cable that also carries communications related to various locomotive operational parameters, such as throttle notch settings. Alternatively, MU cable 250 may be a separate cable provided specifically to transfer communications and data between the locomotives and the tender car. In alternative implementations, two separate tender car controllers may be provided on tender car 230 instead of two distinct ports on one tender car controller. Still further alternative implementations may include additional communication cabling (not illustrated) separate from MU cable 250 between each locomotive controller and each tender car controller or controller port. Natural gas conduits 270 and vaporizer heating fluid conduits 280 may run between each locomotive and the tender car. Additional alternative implementations may include using the natural gas conduits 270 as communication medium rather than running additional communication cabling. Each natural gas conduit 270 may be configured for use as a waveguide for microwaves or radio waves at frequencies controllable by radio modems. Alternatively, each natural gas conduit 270 may be configured for direct propagation of signals through the conduit. In these examples of independent point-to-point communication paths between each locomotive and the tender car, no further identification information may be needed in order to establish which locomotive is connected to which end of the tender car.

In the exemplary implementation illustrated in FIG. 3, a standard MU cable 350 may be connected between locomotive controller 322 on locomotive 320, tender car controller 332 on tender car 330, and locomotive controller 342 on locomotive 340. Natural gas conduits 370 and vaporizer heating fluid conduits 380 may also be connected between each locomotive 320, 340 and tender car 330. Additionally, a power cable 360 may be connected between each locomotive 320, 340 and tender car 330. Power cable 360 may be an existing cable for providing electrical power to various devices on tender car 330, such as pumps, compressors, processors, and refrigeration components. Power cable 360 may be modified to accommodate unique and identifiable features at each end of tender car 330. In particular, additional wires, pins, and/or jumper wires may be added to power cable 360 or tender car power connectors 334, 336 at each end of tender car 330. Each locomotive controller 322, 342 may transmit a steady state or dynamic signal over power cable 360 in order to identify which end of tender car 330 the associated locomotive 320, 340 is connected to. Portions of power cable 360 or tender car power connectors 334, 336 may be configured to affect an electrical parameter of the signal sent by each locomotive controller. The electrical parameter may include a current, a voltage, a frequency, a magnetic field, or other identifiable and measurable characteristic.

Figure 4:
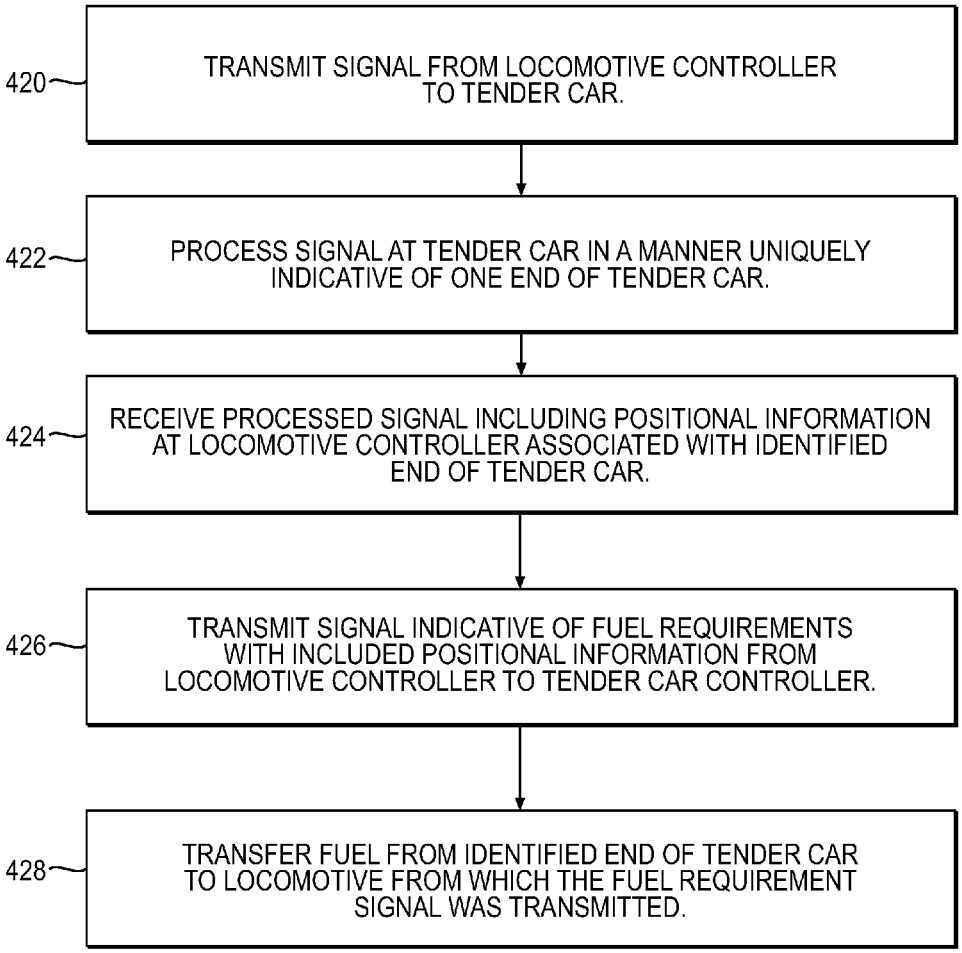
FIG. 4 is a flow chart of an exemplary process that may be performed by the exemplary systems of FIGS. 1-3.

FIG. 4 illustrates an exemplary disclosed method of determining the positional relationship between a locomotive in a consist and a tender car in the consist. The method steps may be stored as instructions on one or more non-transitory computer readable medium for execution by one or more controllers. FIG. 4 will be discussed in more detail in the following section to further illustrate the disclosed concepts.

INDUSTRIAL APPLICABILITY

The disclosed system and method for determining the positional relationships between locomotives and a tender car in a consist may facilitate high speed communications between the locomotives and the tender car over a common ethernet communication bus. Regardless of how the various locomotives in the consist are rearranged relative to each other and to the tender car at different points during operation of the train, their respective controllers can continue to communicate necessary operational commands.

As shown in the exemplary disclosed flowchart of FIG. 4, at step 420 a locomotive controller may transmit a signal to the tender car. The signal may be transmitted over a common ethernet communication bus superimposed on an existing MU cable, superimposed on an MU cable added specifically to accommodate data communications regarding fuel transfers, or provided over a dedicated communication link. The signal may be one of various enable or acknowledge signals. In various implementations the signal transmitted by a locomotive controller may establish handshake protocols with the receiving controller at the tender car, communicate a fuel request, acknowledge fuel delivery, or provide other status information. Alternatively, a steady state or dynamic signal may be transmitted by the locomotive controller over a modified power cable running between the locomotive and the tender car. The signal transmitted over the power cable may be looped back to the locomotive controller without interaction with the tender car controller. An electrical parameter of the signal may be modified by characteristics uniquely indicative of the end of the tender car that received the signal. These characteristics may include various pins or jumper wires added to the power cable or to a tender car power connector at each end of the tender car.

In an alternative implementation, one or more locomotive controllers may transmit a plurality of signals to the tender car. Plural locomotive controllers may coordinate between themselves in transmitting successive control signals to the tender car controller.

At step 422, the signal received at the tender car may be processed in a manner uniquely indicative of one end of the tender car. In the above-discussed implementation including the transmission of a signal over a power cable, the signal may be modified at the tender car by physical characteristics of the electrical path. In various alternative implementations, the tender car controller may process a signal received from a locomotive controller to command an operational characteristic associated with a particular end of the tender car. Successive signals received from one or more locomotive controllers may be processed by the tender car controller to direct successive control commands for operational characteristics at different ends of the tender car. For example, a first signal received from a locomotive controller may result in the tender car controller activating a valve at a first end of the tender car to receive vaporizer heating fluid. A second successive signal received from the same or different locomotive controller may result in activation of a similar valve at the second, opposite end of the tender car. Another operational characteristic unique to each end of the tender car may be activation of a pump that begins the transfer of natural gas from that end of the tender car. In one implementation discussed above, a power cable connecting a locomotive to the tender car has been modified to accommodate unique and identifiable features at each end of the tender car. An electrical signal received at one end of the tender car through the power cable is therefore affected differently than it would be if received at the opposite end of the tender car. Similarly, a signal sent to the tender car controller to operate a pump at one end of the tender car may result in a change in operational characteristics such as pressure at that one end of the tender car. The processing of a signal sent from a locomotive to one end of the tender car may therefore result in an identifiable effect unique to that end of the tender car. This identifiable effect may be used to provide positional information to a locomotive connected to that end of the tender car.

At step 424, a locomotive controller associated with an identified end of the tender car may receive the processed signal including positional information. As one example, a signal received at the tender car from a locomotive controller may result in the activation of a valve at the connection between a first end of the tender car and the vaporizer heating fluid conduit. The locomotive connected at the other end of the vaporizer heating fluid conduit may sense this operational characteristic as a change in pressure in the conduit. The result of this interchange between the locomotive controller and the tender car is that the locomotive controller is now provided with positional information associated with an identified end of the tender car. In implementations where an independent and distinct communication path is provided between a locomotive and a controller or controller port associated with one end of the tender car, the locomotive controller may already have this positional information. In an additional alternative implementation, a train operator may manually enter which end of the attached tender car the locomotive is connected to via some input device, such as a switch, lever, button, or icon on a graphical user interface (GUI).

Additional alternative implementations may include various methods for uniquely identifying the end of the tender car connected to a particular locomotive. One method may include providing uniquely programmed radio frequency identification (RFID) tags at each end of the tender car, which can be read by tag readers on the locomotives. Another variation may include providing uniquely programmed optical tags at each end of the tender car, which can be read by an optical reader installed on the locomotive. Yet another variation may include providing short range wireless communication devices with directional antennas at each end of the tender car to communicate with a receiver on the immediately adjacent locomotive.

At step 426, a locomotive controller may transmit a signal indicative of fuel requirements or other operational parameters, along with the acquired positional information to the tender car controller. The positional information includes the information on which end of the tender car is actually connected to which locomotive. As discussed above, this positional information may be used by the tender car controller connected over a common ethernet communication bus with the controllers of more than one locomotive. The positional information allows the tender car controller to distinguish which signals came from which locomotive controllers, and which end of the tender car an associated locomotive is connected to.

At step 428, the tender car controller may now transfer fuel from the identified end of the tender car to the locomotive from which the fuel requirement signal was transmitted. The system in accordance with the exemplary disclosed implementations allows the tender car controller to distinguish between the locomotives connected to the tender car. In addition, the tender car controller may be provided with positional information by a locomotive controller that allows the tender car to identify which end of the tender car the locomotive associated with the locomotive controller is connected to. The inclusion of this positional information may facilitate communication between the locomotives and the tender car using high speed communications over a common ethernet communication bus.

It will be apparent to those skilled in the art that various modifications and variations can be made to the system and method of the present disclosure. Other embodiments will be apparent to those skilled in the art from consideration of the specification and practice of the method and system disclosed herein. It is intended that the specification and examples be considered as exemplary only, with a true scope of the disclosure being indicated by the following claims and their equivalents.

What is claimed is:

1. A method of determining the positional relationship between a locomotive in a consist and a tender car in the consist, the method comprising:

transmitting a signal from a locomotive controller to the tender car;

processing the signal at the tender car in a manner uniquely indicative of one end of the tender car;

receiving an indication of an effect of the signal processing at a locomotive controller associated with the locomotive;

using the indication of an effect of the signal processing at the locomotive controller associated with the locomotive to establish the positional relationship between the locomotive and the one end of the tender car;

transmitting a signal from the locomotive controller associated with the locomotive indicative of a fuel requirement and including the positional relationship to a controller associated with the tender car; and transferring fuel from the one end of the tender car to the locomotive.

2. The method of claim 1, wherein transmitting a signal from the locomotive controller to the tender car includes transmitting an electrical signal over a power cable providing electrical power from the locomotive to the tender car.

3. The method of claim 2, wherein processing the signal at the tender car includes modifying an electrical parameter of the electrical signal transmitted over the power cable.

4. The method of claim 3, wherein the electrical parameter of the electrical signal transmitted over the power cable is modified by looping the signal back to the locomotive controller through a jumper wire unique to a power connector connecting the power cable at the one end of the tender car.

5. The method of claim 1, wherein transmitting a signal from the locomotive controller to the tender car includes transmitting the signal over an ethernet communication bus superimposed on a multi-unit cable configured for carrying throttle commands between locomotives in the consist.

6. The method of claim 5, wherein transmitting a signal from the locomotive controller to the tender car includes transmitting a command signal to the tender car controller to initiate an operational characteristic at one end of the tender car.

7. The method of claim 1, wherein the processing of the signal at the tender car includes initiating operation of a device at the one end of the tender car.

8. The method of claim 7, wherein the device at the one end of the tender car is used in the transfer of vaporizer heating fluid from the locomotive to the tender car.

9. The method of claim 8, wherein the device at the one end of the tender car is used in the transfer of gas between the tender car and the locomotive.

10. A system for determining the positional relationship between vehicles in a consist, the system comprising:

a locomotive;

a tender car, wherein the tender car includes operational characteristics that identify and distinguish between respective ends of the tender car;

a tender car controller associated with the tender car; and a locomotive controller associated with the locomotive, wherein the locomotive controller is configured to:

transmit a signal to the tender car that will activate at least one of the operational characteristics; and identify results of activating the at least one operational characteristic associated with an end of the tender car connected to the locomotive wherein the locomotive controller is further configured to:

use the identification of the results of activating the unique operational characteristic to establish a positional relationship between the locomotive and the end of the tender car connected to the locomotive;

transmit a signal from the locomotive controller indicative of fuel requirements and including the positional relationship to the tender car controller; and transfer fuel from the end of the tender car connected to the locomotive to the locomotive.

11. The system of claim 10, further including:

a power cable connected between the locomotive and the tender car, the power cable configured for providing electrical power from the locomotive to the tender car;

wherein an operational characteristic associated with the end of the tender car connected to the locomotive includes a modification to an electrical path for electrical current transmitted through the power cable to the end of the tender car; and the modification to the electrical path results in an electrical parameter of an electrical signal transmitted over the power cable uniquely indicative of the end of the tender car.

12. The system of claim 11, wherein the modification to the electrical path includes a jumper wire unique to a power connector connecting the power cable at the end of the tender car.

13. The system of claim 10, further including an ethernet communication bus providing a communication link between the locomotive and the tender car; and wherein the locomotive controller is further configured to transmit a signal to the tender car over the ethernet communication bus.

14. The system of claim 13, further including at least one multi-unit cable connected between the locomotive and the tender car, the at least one multi-unit cable being configured for carrying operational commands between locomotives in the consist; and wherein the ethernet communication bus is superimposed on a portion of the at least one multi-unit cable.

15. The system of claim 10, wherein the operational characteristics include a device at the end of the tender car connected to the locomotive; and the locomotive controller is further configured to transmit a control action signal to the tender car controller to initiate operation of the device.

16. The system of claim 15, wherein the device at the end of the tender car connected to the locomotive is used in the transfer of vaporizer heating fluid from the locomotive to the tender car.

17. The system of claim 10, further including:

a power cable connected between the locomotive and the tender car, the power cable configured for providing electrical power from the locomotive to one or more devices on the tender car, wherein an operational characteristic associated with one end of the tender car includes a modification to an electrical path for electrical current transmitted through the power cable to the one end of the tender car, and the modification to the electrical path results in an electrical parameter of an electrical signal transmitted over the power cable uniquely indicative of the one end of the tender car.

18. A system for determining the positional relationship between vehicles in a consist, the system comprising:

a locomotive;

a tender car;

a natural gas conduit connecting the locomotive and one end of the tender car;

a tender car controller associated with the tender car; and a locomotive controller associated with the locomotive, wherein the locomotive controller is configured to:

transmit a signal to the tender car controller that will enable the tender car controller to identify a position of the one end of the tender car with respect to the locomotive.

19. The system of claim 18, wherein the tender car controller is a first tender car controller associated with a first end of the tender car, and the system further including:

a second tender car controller associated with a second end of the tender car; and the natural gas conduit forming a communication medium configured for transmitting the signal from the locomotive controller to the tender car controller.

* * * * *